US005839684A

United States Patent [19]

Poloni et al.

[11] Patent Number: 5,839,684

[45] Date of Patent: Nov. 24, 1998

[54] LINED PIPE FOR FORMING SPIRALS FOR SPIRALLING MACHINES AND THE RELATIVE RECONDITIONING METHOD

[75] Inventors: Alfredo Poloni, Fogliano Di Redipuglia; Fausto De Marco, Remanzacco, both of Italy

[73] Assignee: Danieli & C. Officine Meccaniche SPA, Buttrio, Italy

[21] Appl. No.: 921,041

[22] Filed: Aug. 29, 1997

[30] Foreign Application Priority Data

Sep. 26, 1996 [IT] Italy ..... UD96 A 000181

[51] Int. Cl.[6] ..... B21C 47/00

[52] U.S. Cl. ..... 242/361; 72/66

[58] Field of Search ..... 242/361; 72/66

[56] References Cited

U.S. PATENT DOCUMENTS 4,047,543 9/1977 Burow .
4,052,498 10/1977 Burow .
4,074,553 2/1978 Woodrow .
4,332,155 6/1982 Pariseau .
4,353,513 10/1982 Holthoff .
4,765,556 8/1988 Nasrah ..... 72/66

FOREIGN PATENT DOCUMENTS 63-295014 12/1988 Japan .

*Primary Examiner*—John P. Darling
*Attorney, Agent, or Firm*—Stevens, Davis, Miller & Mosher, L.L.P.

[57] ABSTRACT

A lined spiral-forming pipe (11) for a spiral-forming head of spiralling machines for metallic wire, comprising a plurality of wear-resistant inserts having an inner hollow through which the metallic wire passes and an outer surface connecting with the inner surface of the spiral-forming pipe (11) and an inner through hollow (12). The wear-resistant inserts (10) are substantially all alike with a substantially annular conformation with a longitudinal dimension ("1") mating with the minimum radius of curvature of the spiral-forming pipe (11), and have rounded front faces (10*a*) at least partly convex. The inner through hollow (12) comprises a first lead-in segment (12*a*) to introduce the metallic wire and a second following segment (12*b*) which is substantially cylindrical. Also included is a method to recondition a spiral-forming pipe (11) of a spiral-forming head in spiralling machines for metallic wire.

20 Claims, 2 Drawing Sheets

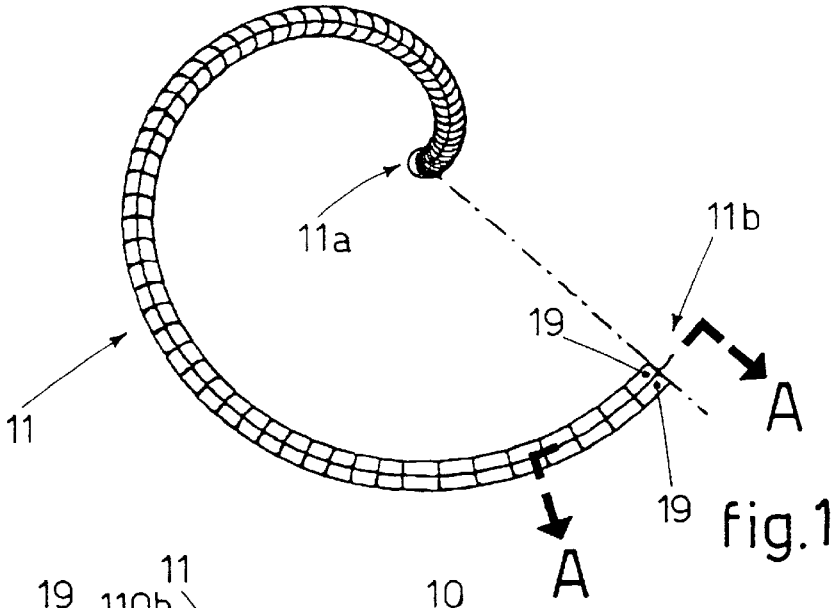
fig.1
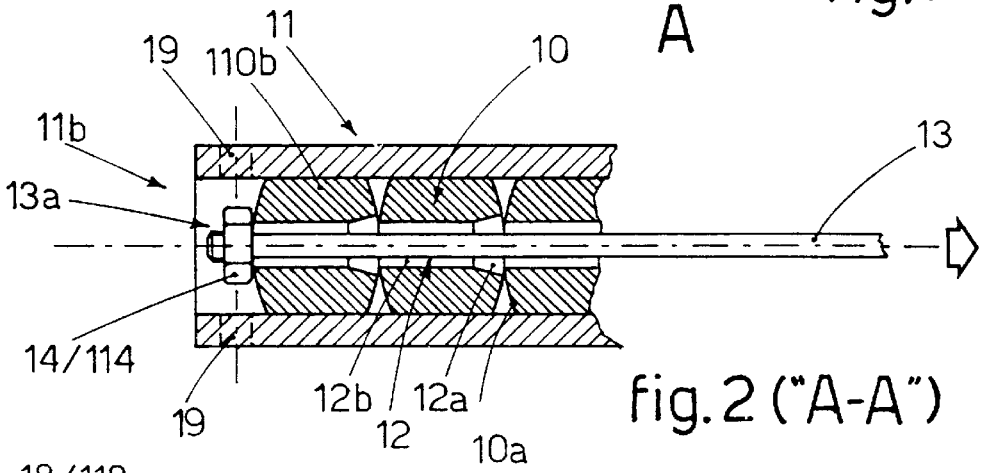
fig.2 ("A-A")
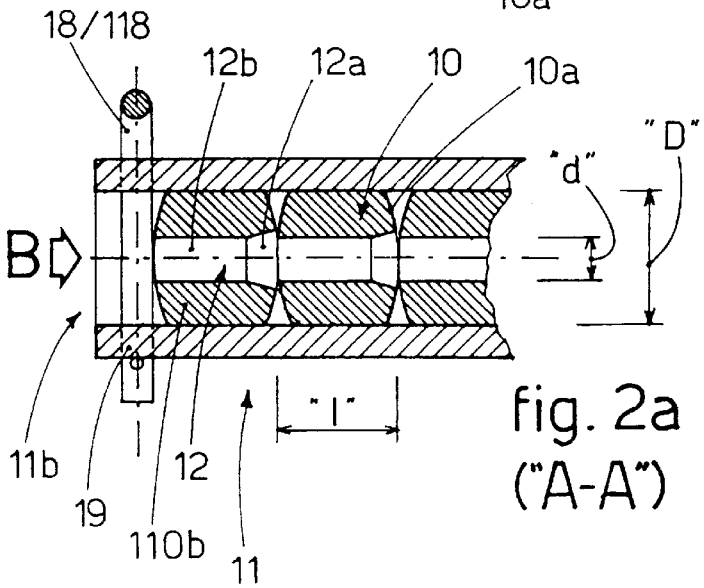
fig. 2a ("A-A")
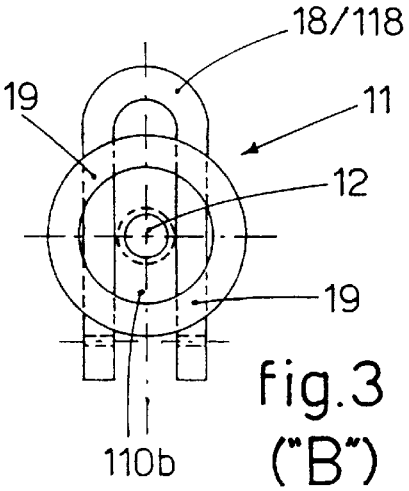
fig.3 ("B")

10a
10
12
13b
15/115
13
11
12b
12a
110a
17
16
11a ("X")
10a
10
12
11
12b
12a
110a
17
16
11a ("X")
11b
11
"X"
11a 10a
10
12
10a 10
10a
12
10a

LINED PIPE FOR FORMING SPIRALS FOR SPIRALLING MACHINES AND THE RELATIVE RECONDITIONING METHOD

FIELD OF THE INVENTION

This invention concerns a lined pipe for forming spirals for spiralling machines and the relative method to recondition them as set forth in the respective main claims.

The invention is applied in spiralling machines with a spiral-forming head used on semifinished products arriving from the hot rolling process, such as wire, rods, round pieces or similar.

BACKGROUND OF THE INVENTION

The state of the art covers machines to obtain spirals from metallic wire of various diameters comprising a spiral-forming rotary head with a pipe to form the spirals.

In these machines the semifinished product arriving from the rolling line is introduced, by the appropriate feeding device, inside the pipe of the spiral-forming head.

The rotary movement of the spiral-forming head, as the metallic wire passes through it, whether this wire be smooth or with protuberances, subjects the relative spiral-forming pipe to strong stresses which can compromise its structural integrity and/or the original geometric configuration.

These stresses are added to the tangential thrusts of the metallic wire as it passes through and cause conditions of friction, and therefore of wear, on the inside of the pipe which are particularly serious.

As the pipe is worn, the machine becomes unbalanced and, when the pipe is replaced, the machine needs rebalancing.

For this reason the spiral-forming pipe of the spiral-forming head is achieved on the understanding that in certain operating conditions it is integrated and lined internally with auxiliary elements possessing high characteristics of resistance to wear.

This solution, although it ensures a longer duration of the spiral-forming pipe and therefore fewer interventions on the same, it also causes problems connected with the high costs of procuring and reconditioning the pipe due to its more complex structure and the fact that it cannot be partly interchanged.

U.S. Pat. No. 4,074,553 teaches to use tubular inserts made of wear-resistant material which are introduced and clamped inside the spiral-forming pipe. These tubular inserts have, on the outer surface, abutment ridges and self-centering ridges which allow them to be reciprocally assembled in order to define a transit channel for the metallic wire inside the spiral-forming pipe.

The particular conformation of these wear-resistant inserts, which includes ridges and grooves on the outer surface, as well as particular conformations of the front and rear end to achieve reciprocal connection, involves high production costs and assembly costs.

The longitudinal dimension of these inserts, moreover, since it must be such as to allow for the above-mentioned grooves and ridges, cannot be less than certain values, which causes problems in positioning the inserts themselves inside the spiral-forming pipe.

Mounting the inserts, moreover, defines a channel of a segmented type which is not particularly suitable to the spiral development of the pipe.

This solution moreover, causes considerable problems during the replacement of the inserts, as the spiral-forming pipe must necessarily be dismantled or even the pipe and also the relative rotary support.

The particular and specific conformation of the inserts, moreover, prevents them from being interchangeable.

The replacement or reconditioning operations are therefore expensive, long and laborious, and cause long interruptions to the spiralling cycle and considerable costs. Moreover, these operations must be carried out by many workers, as dismantling and assembling the spiral-forming pipe is extremely complex.

SUMMARY OF THE INVENTION

The present applicants have therefore designed, tested and embodied this invention to overcome the shortcomings of the state of the art and to achieve further advantages.

This invention is set forth and characterized in the respective main claims, while the dependent claims describe variants of the idea of the main embodiment.

The purpose of the invention is to provide a lined pipe to form spirals for spiralling machines which is simple, functional and practical, allowing a rapid reconditioning and therefore limited down times of the cycle and extremely reduced costs.

A further purpose of the invention is to facilitate the operations of inserting/extracting the lining, allowing it to be done by one worker alone.

A further purpose is to obtain a wear-resistant lining composed of inserts of a single type, of small size and of simple shape and therefore economical to obtain and adaptable to the spiral-shaped development of the spiral-forming pipe.

It is also a purpose of the invention to be able to rotate the inserts randomly and obtain a restoration of the transit channel without replacing the inserts themselves for a number of times, even more than 10 restorations.

The wear-resistant inserts which make up the lining of the pipe according to the invention are substantially composed of an annular element with an outer diameter mating with the inner diameter of the spiral-forming pipe inside which the inserts must be introduced and a reduced inner diameter mating with the diameter of the metallic wire.

The inner hollow of the wear-resistant inserts has a first connecting or lead in portion and a second, substantially cylindrical portion.

The outer surface of these wear-resistant inserts is substantially cylindrical, which gives an extremely simple production process and makes it very easy to insert/extract them. Moreover, the reduced longitudinal dimension of the wear-resistant inserts, which varies from 20 to 40 mm, advantageously 30 mm, gives them characteristics which make them extremely adaptable to the spiral-shaped development of the spiral-forming pipe.

These characteristics of adaptability are increased by the substantially spherical or curved conformation of the front faces of the inserts which allows them to be arranged in continous contact even in the arched portions of the spiral-forming pipe.

According to the invention, the inlet mouth of the spiral-forming pipe communicates with the inlet to the inner hollow of the first wear-resistant insert.

According to the invention, the wear-resistant inserts are inserted into the spiral-forming pipe, and extracted from it, by means of a flexible cable element or a similar or comparable element.

This cable element has, in correspondence with at least one of its ends, means to temporally constrain the inserts.

According to the invention, in order to restore the transit channel without replacing the inserts, the inserts are extracted by means of the flexible cable element, they are made to rotate randomly around the flexible cable element, then they are re-inserted; in this way the preferential channel which had been created is removed, and the transit channel is restored to optimum conditions.

In one embodiment of the invention, in correspondence with a first end, the cable has constraining means of the type which can be disassociated from the cable itself and cooperating with the front face of the insert, while in correspondence with the second end the cable has constraining means of the type which come into contact with the inner hollow of the inserts.

The lining is introduced, in one embodiment of the invention, by progressively threading a desired number of inserts onto the cable, as they are constrained, at the first end of the cable and therefore cannot come unthreaded from the above-mentioned constraining means.

The second end of the cable is then introduced from the outlet mouth of the spiral-forming pipe until it comes out of the inlet mouth of the same pipe.

When all the inserts are located inside the spiral-forming pipe, the constraining means of the dissociable type, are removed from the cable and the cable itself is unthreaded from the spiral-forming pipe.

Subsequently, in correspondence with the outlet mouth of the spiral-forming pipe, are introduced holding means for the inserts which are therefore clamped between the holding means and the abutment means associated with the inlet mouth of the spiral-forming pipe.

The inserts are extracted from the spiral-forming pipe by inserting the first end of the cable into the inlet mouth, until it comes out from the outlet mouth of the spiral-forming pipe. By pulling the first end of the cable, the constraining means of the second end come into contact with the inner hollow of the first insert; this first insert, constrained to the cable, is therefore dragged together with all the others towards the outer part of the spiral-forming pipe.

BRIEF DESCRIPTION OF THE DRAWINGS

The attached figures are given as a non-restrictive example and show a preferred embodiment of the invention as follows:

FIG. 1 shows a front view of a spiral-forming pipe with a lining which is replaceable by means of the method according to the invention;

FIG. 2 shows the section "A—A" of FIG. 1 as the wear-resistant inserts are being inserted;

FIG. 2*a* shows the section "A—A" of FIG. 1 when the inserts have been completely inserted;

FIG. 3 shows the view from "B" of FIG. 2*a;*

DETAILED DESCRIPTION OF THE PREFERRED EMBODIMENTS

Figures 4, 5, 5A, 6A, 6B:
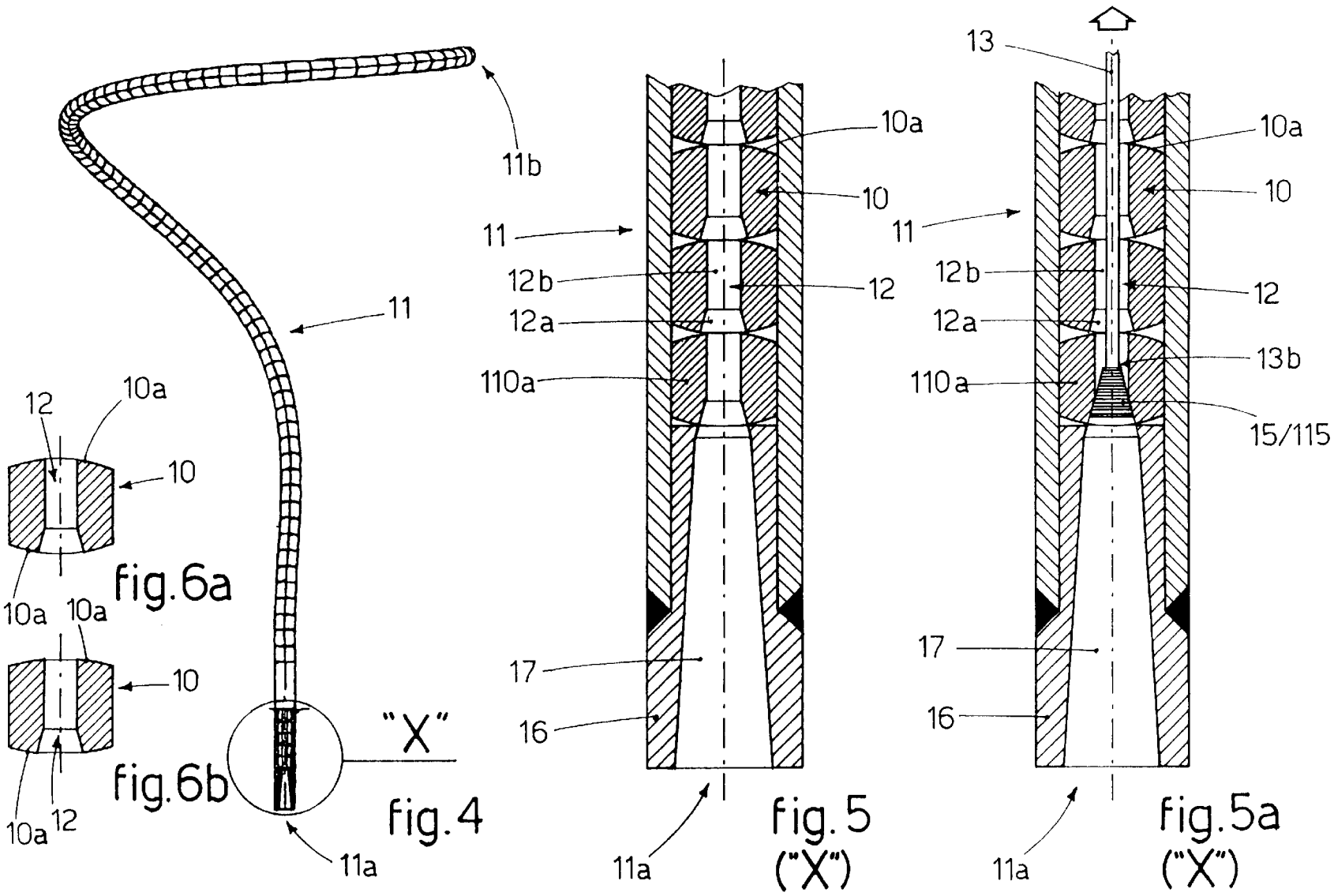
FIG. 4 shows a partly sectioned view from above of the spiral-forming pipe of FIG. 1.
FIG. 5 shows the enlarged view of the detail "X" from FIG. 4 when the wear-resistant inserts have been completely inserted.
FIG. 5*a* shows the detail "X" from FIG. 4 as the inserts are being extracted.
FIG. 6*a* shows the first form of embodiment of the insert.
FIG. 6*b* shows a variant of FIG. 6*a*.

The spiral-forming pipe 11 according to the invention includes inside itself wear-resistant inserts 10 of an annular conformation defining an inner hollow 12; this hollow 12 comprises, in this case, a first lead in segment 12*a*, which is shaped like a truncated cone, and a second substantially cylindrical segment 12*b,* with a section which substantially coincides with the lesser section of the first segment 12*a*.

The outer diameter "D" of the wear-resistant insert 10 is slightly less than the inner diameter of the spiral-forming pipe 11; while the inner diameter "d" of the cylindrical segment 12*b* of the inner hollow 12 is correlated in size to the diameter of the metallic wire.

The insert 10 has rounded front faces 10*a* outwardly convex so as to adapt better to the geometry of the spiral-forming pipe 11.

In the embodiment shown in FIG. 6*a,* the rounded shape extends over the entire surface of the front face 10*a* of the wear-resistant insert 10.

In the variant shown in FIG. 6*b,* the rounded shape extends only on at least part of the outer circumference of the hollow 12 in such a way as to give a better connection between adjacent wear-resistant inserts 10.

The longitudinal dimension "1" of the wear-resistant inserts is between 20 and 40 mm, advantageously with a nominal value of about 30 mm.

In this case, the spiral-forming pipe 11 is solidly associated, in correspondence with its inlet mouth 11*a,* with a lead-in element 16 with an inner channel 17 shaped like a truncated cone, the lesser section of which substantially concides with the greater section of the hollow 12 of the inserts 10.

The replacement of the wear-resistant inserts 10 is carried out by means of a flexible metallic cable 13 which has means to constrain the wear-resistant inserts 10 at its two ends 13*a,* 13*b*.

In correspondence with a first end 13*a* the cable 13 has, in this case, constraining means 14 of the removable type, in this case composed of a nut 114 associated with a thread made on this first end 13*a*.

In correspondence with the second end 13*b* the cable 13 has constraining means 15 cooperating with the truncated cone segment 12*a* of the hollow 12, in this case composed of a contrasting cone 115 which is of such a size that it will pass through the lead-in element 16 but not through the cylindrical segment 12*b* of the hollow 12.

The wear-resistant inserts 10 are inserted into the spiral-forming pipe 11 of the spiral-forming head by threading, by means of the cable 13, a certain number of wear-resistant inserts 10 suitable to cover the entire length of the spiral-forming pipe 11, the cable 13 mounting the nut 114, on its first end 13*a,* which abuts on the outer part of the last wear-resistant insert 10*b*.

The second end 13*b* of the cable 13 is then introduced into the spiral-forming pipe 11 from its outlet mouth 11*b* until it comes out of its inlet mouth 11*a*.

The cable 13 is then pulled, thus causing the wear-resistant inserts 10 to be dragged into the spiral-forming pipe 11 until the first wear-resistant insert 110*a* is taken to the abutment position against the lead-in element 16.

The nut 114 is then unthreaded from the first end of the cable 13*a* thus allowing the cable 13 to be extracted from the inlet mouth 11*a* of the spiral-forming pipe 11.

Subsequently, means 18 to hold the wear-resistant inserts 10 are associated with the outlet mouth 11*b* of the spiral-forming pipe 11; in this case, these means 18 are composed of a fork 118 inserted into mating holes 19 made on the spiral-forming pipe 11 and including its own clamping means.

The wear-resistant inserts 10 are extracted from the spiral-forming pipe 11 by inserting the first end 13*a* of the cable 13, dissociated now from the nut 114, into the inlet mouth 11*a* until it comes out from the outlet mouth 11*b*.

The subsequent pulling of the cable 13 causes the contrasting cone 115 to come into contact with the truncated cone segment 12*a* of the hollow 12 of the first wear-resistant insert 110*a*. This contrasting cone 115, as it cannot pass through the hollow 12, causes the wear-resistant inserts 10 to be pushed towards the outlet mouth 11*b* and thus allows them to be extracted from the spiral-forming pipe 11.

We claim:

1. A lined spiral-forming pipe (11) for a spiral-forming head of spiralling machines for metallic wire, comprising a plurality of wear-resistant inserts having an inner hollow through which the metallic wire passes and an outer surface connecting with the inner surface of the spiral-forming pipe (11), wherein the wear-resistant inserts (10) are substantially all alike with a substantially annular conformation with a longitudinal dimension ("1") mating with the minimum radius of curvature of the spiral-forming pipe (11), and have rounded front faces (10*a*) at least partly convex and an inner through hollow (12) comprising a first lead-in segment (12*a*) to introduce the metallic wire and a second following segment (12*b*) which is substantially cylindrical.

2. A spiral-forming pipe as in claim 1, wherein there is a shaped inlet mouth (11*a*) with a lead-in element (16) defining abutment means for the first wear-resistant insert (110*a*).

3. The spiral-forming pipe as in claim 2, wherein the wear-resistant insert (10) has a longitudinal dimension ("1") of between 20 and 40 mm.

4. The spiral-forming pipe as in claim 2, wherein the wear-resistant insert (10) has a longitudinal dimension ("1") of about 30 mm.

5. The spiral-forming pipe as in claim 2, wherein the lead-in and introduction segment (12*a*) of the hollow (12) in the wear-resistant insert (10) is shaped like a truncated cone.

6. The spiral-forming pipe as in claim 2, wherein the wear-resistant insert (10) has its outer surface connecting with the inner surface of the pipe (11).

7. The spiral-forming pipe as in claim 2, wherein the wear-resistant insert (10) has its front face (10*a*) at least partly rounded.

8. The spiral-forming pipe as in claim 2, wherein the spiral-forming pipe is associated with a lead-in element (16) having a passage hole (17), wherein the inlet diameter of the lead-in and introduction segment (12*a*) of the wear-resistant insert (10) has a dimension substantially flush with an outlet dimension of the passage hole of the lead-in element (16).

9. The spiral-forming pipe as in claim 2, wherein the spiral-forming pipe has an outlet mouth (11*b*), wherein a holding means (18) of the last wear-resistant insert (110*b*) is located at or adjacent the outlet mouth (11*b*).

10. The spiral-forming pipe as in claim 1, wherein the wear-resistant insert (10) has a longitudinal dimension ("1") of between 20 and 40 mm.

11. The spiral-forming pipe as in claim 1, wherein the wear-resistant insert (10) has a longitudinal dimension ("1") of about 30 mm.

12. The spiral-forming pipe as in claim 1, wherein the lead-in and introduction segment (12*a*) of the hollow (12) in the wear-resistant insert (10) is shaped like a truncated cone.

13. The spiral-forming pipe as in claim 1, wherein the wear-resistant insert (10) has its outer surface connecting with the inner surface of the pipe (11).

14. The spiral-forming pipe as in claim 1, wherein the wear-resistant insert (10) has its front face (10*a*) at least partly rounded.

15. The spiral-forming pipe as in claim 1, wherein the spiral-forming pipe is associated with a lead-in element (16) having a passage hole (17), wherein the inlet diameter of the first lead-in segment (12*a* ) of the wear-resistant insert (10) has a dimension substantially flush with the outlet dimension of the passage hole of the lead-in element (16).

16. The spiral-forming pipe as in claim 1, wherein the spiral-forming pipe has an outlet mouth (11*b*), wherein a holding means (18) of the last wear-resistant insert (110*b*) is located at or adjacent the outlet mouth (11*b*).

17. The spiral-forming pipe as in claim 16, wherein the holding means are fork means (118) passing through insertion holes (19) in the spiral-forming pipe (11), there also being included clamping means for the fork means (118).

18. A method to recondition a spiral-forming pipe (11) of a spiral-forming head in spiralling machines for metallic wire, the pipe (11) including inside itself a plurality of wear-resistant inserts defining an inner hollow through which the metallic wire passes, the inserts including an outer surface connecting with the inner surface of the spiral-forming pipe (11), comprising inserting the wear-resistant inserts (10) into the spiral-forming pipe (11) by means of a flexible cable element (13) including, at least one end (13*b*), at least temporal constraining means (15) in contact with at least one member selected from the group consisting of the inner hollow (12) and the front wall of the wear-resistant inserts (10), the cable element (13), with the wear-resistant inserts (10) being threaded from one mouth (11*a,* 11*b*) of the spiral-forming pipe (11) until the first wear-resistant insert (110*a*) is taken to an abutment position against an abutment element at or adjacent the other mouth (11*a,* 11*b*) and then clamping the last wear-resistant insert with holding means, extracting the wear-resistant inserts (10) from the spiral-forming pipe (11), after the holding means have been released, by introducing the flexible cable element (13) from the other mouth (11*b,* 11*a*) of the pipe (1), until the temporal constraining means (15) is taken into contact with, and then clamps itself against the at least one member selected from the group consisting of the inner hollow (12) and the front wall of the first wear-resistant insert (110*a*), wherein the whole assembly of wear-resistant inserts (10) is extracted.

19. The method as in claim 18, wherein the introduction of the cable element (13) with the wear-resistant inserts (10) is achieved from the outlet mouth (11*b*) of the pipe (11) until the first wear-resistant insert (110*a*) is taken to an abutment position against a lead-in element (16) associated with the inlet mouth (11*a*) of the pipe (11), while the extraction of the wear-resistant inserts (11) is achieved by introducing the cable element (13) from the inlet mouth (11*a*) of the pipe (11) until the temporal constraining element (15) is taken into contact with the inner hollow (12) of the first wear-resistant insert (110*a*).

20. The method as in claim 18, wherein the wear-resistant inserts (10) are extracted by means of the cable element (13), are made to rotate randomly on the cable element (13) and are re-inserted and clamped.

* * * * *